US007190911B2

(12) United States Patent
Sato et al.

(10) Patent No.: US 7,190,911 B2
(45) Date of Patent: Mar. 13, 2007

(54) DETACHABLE UNIT, IMAGE FORMING APPARATUS, SERVER COMPUTER, COMPUTER PROGRAM, AND CLIENT SYSTEM

(75) Inventors: Hideki Sato, Iwatsuki (JP); Masaharu Inaba, Iwatsuki (JP); Hitoshi Nanba, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/726,629

(22) Filed: Dec. 4, 2003

(65) Prior Publication Data

US 2004/0240893 A1 Dec. 2, 2004

(30) Foreign Application Priority Data

May 28, 2003 (JP) ..... 2003-151254

(51) Int. Cl.
*G03G 15/00* (2006.01)

(52) U.S. Cl. ..... 399/8; 399/12; 399/25

(58) Field of Classification Search ..... 399/8, 399/12, 13, 25, 111, 119, 122
See application file for complete search history.

(56) References Cited

U.S. PATENT DOCUMENTS 5,974,312 A * 10/1999 Hayes et al. ..... 455/419
6,798,997 B1 * 9/2004 Hayward et al. ..... 399/12

FOREIGN PATENT DOCUMENTS

| | | |
|---|---|---|
| JP | 05-142880 | * 11/1991 |
| JP | 5-142880 | 6/1993 |
| JP | 05-142880 | * 11/1993 |
| JP | 8-310088 | 11/1996 |
| JP | 9-230738 | 9/1997 |
| JP | 2000-356870 | 12/2000 |

* cited by examiner

*Primary Examiner*—Hoang Ngo
(74) *Attorney, Agent, or Firm*—Morgan, Lewis & Bockius, LLP

(57) ABSTRACT

A technical solution for easily carrying out detailed image formation control corresponding to respective customers, i.e., a detachable unit, an image forming apparatus, a server computer, a computer program and client system for easily carrying out detailed image formation control corresponding to respective customers, is to be provided. The detachable unit is a detachable unit detachable to an image forming apparatus, the detachable unit has a memory part storing information containing control information, and upon mounting the detachable unit on an image forming apparatus main member, operation of the image forming apparatus is controlled based on the information stored in the memory part.

3 Claims, 9 Drawing Sheets

DETACHABLE UNIT, IMAGE FORMING APPARATUS, SERVER COMPUTER, COMPUTER PROGRAM, AND CLIENT SYSTEM

BACKGROUND OF THE INVENTION

1. Field of the Invention

The present invention relates to an image forming apparatus for a duplicator, a printer, a facsimile machine and a complex machine thereof, and related technologies.

2. Description of the Related Art

Image forming apparatuses utilizing electrophotography (electrostatic transfer system), such as a duplicator and a printer, have been known. The image forming apparatus is constituted in such a manner that the control conditions thereof are modified depending on the kind of the toner and the like.

For example, JP-A-2000-356870 discloses such a technique in that kind information of a toner is previously stored in a memory mounted on a toner cartridge, and in a fixing device of an image forming apparatus having the toner cartridge installed therein, the fixing temperature and the like are appropriately selected and set depending on the kind information of the toner.

However, only the kind information of toners is insufficient to carry out detailed image formation control corresponding to environments of customers. Particularly, in the case where there are plural OEM partners, there is an increasing demand for setting different kinds of image forming information for the respective OEM partners.

SUMMARY OF THE INVENTION

The invention has been made in view of the technical problems and to provide a technical solution for easily carrying out detailed image formation control corresponding to respective customers, i.e., a detachable unit, an image forming apparatus, a server computer, a computer program and client system for easily carrying out detailed image formation control corresponding to respective customers.

In one aspect of the invention, a detachable unit according to the invention is a detachable unit detachable to an image forming apparatus, the detachable unit has a memory part storing information containing control information, and upon mounting the detachable unit on an image forming apparatus main member, operation of the image forming apparatus is controlled based on the information stored in the memory part. In this aspect, either operation of the detachable unit or operation of the image forming apparatus main member may be controlled based on the information stored in the memory part.

The memory part of the detachable unit may store control information corresponding to a destination of the detachable unit. Specific examples of the information corresponding to destination include control information corresponding to a language, a region, a country, a company and a customer (personal or corporation) of the destination of the detachable unit, control information corresponding to a demand standard (of image formation) of a region, a country, a company and a customer (personal or corporation) of the destination of the detachable unit, control information corresponding to environments (temperature, humidity, altitude and season) of the destination of the detachable unit, and control information corresponding to paper quality of a region, a country, a company and a customer (personal or corporation) of the destination of the detachable unit.

The control information stored in the memory part of the detachable unit may be updated i times ($1 \leqq i \leqq n$, where i and n each represent a natural number) corresponding to n-th destinations of from a manufacturer to an end customer of the detachable unit. The control information stored in the memory part may be one that is capable of being updated under a state where the detachable unit is not mounted on the image forming apparatus main member. The detachable unit may have a reception part for receiving an external signal, and the control information stored in the memory part may be updated based on the signal received by the reception part. The control information stored in the memory part may be updated at least once from an initial state.

The memory part of the detachable unit may store (in addition to the control information) specification information showing specification of the detachable unit and use history information showing use history of the detachable unit.

In another aspect of the invention, an image forming apparatus according to the invention contains an image forming apparatus main member, a detachable unit detachable to the image forming apparatus main member, and a control unit for controlling operation of the image forming apparatus, the detachable unit contains a memory part storing information containing control information, and the control unit controls operation of the image forming apparatus based on the information stored in the memory part.

In this aspect, the control unit may control, based on the information stored in the memory part, either operation of the detachable unit or operation of the image forming apparatus main member.

Examples of the specific constitution of the detachable unit include an image forming unit for forming a toner image on a recording sheet, a fixing unit for fixing a toner image formed on a recording sheet, and a toner cartridge having a toner charged therein.

For example, the detachable unit may be a fixing unit for fixing a toner image formed on a recording sheet, and the control unit may control operation of the fixing unit based on the information stored in the memory part. In alternative, for example, the detachable unit may be an image forming unit for forming a toner image on a recording sheet, the image forming apparatus main member may contain a fixing unit for fixing the toner image formed on the recording sheet, and the control unit may control operation of the fixing unit based on the information stored in the memory part.

The image forming apparatus may have an output unit for outputting information to a user, the memory part may store, as the control information, delivery agent information showing delivery agent of the detachable unit, specification information showing specification of the detachable unit and use history information showing use history of the detachable unit, and in the case where it is decided that a time for replacement of the detachable unit approaches based on the specification information and the use history information, the control unit may output the delivery agent information to the output unit. In this case, furthermore, the output unit may be an input and output interface to a computer, and the delivery agent information may be output to a user through an output unit of a computer connected to the input and output interface.

In the image forming apparatus, the memory part may store advertisement information as the control information, and the control unit may print the advertisement information on a recording sheet upon forming an image. In this case, the control unit may print the advertisement information on a non-image area of the recording sheet upon forming an image. The image forming apparatus may have an input unit for inputting information from a user, and the control unit may print the advertisement information on a recording sheet based on a preference of the user input from the input unit. In this case, furthermore, the input unit may be an input and output interface to a computer, and the preference may be input by a user through an input unit of a computer connected to the input and output interface.

The image forming apparatus may have an accounting unit for accounting corresponding to a number of times of image formation, and the control unit may reduce the account in the case where the advertisement information is printed upon forming an image.

In still another aspect of the invention, a server computer according to the invention capable of communicating with plural client computers through an information communication network, the server computer stores control information corresponding to the client computers and transmits the control information to the client computers, and the control information is information that controls an image forming apparatus.

In a further aspect of the invention, a computer program according to the invention for a server computer capable of communicating with plural client computers through an information communication network, the computer program transmits control information stored in the server computer to a client computer, and the control information is information that controls an image forming apparatus.

In a still further aspect of the invention, a client system according to the invention contains a client computer capable of communicating with a server computer through an information communication network, and a writing device for writing control information obtained from the client computer on a memory part of a detachable unit detachable to an image forming apparatus, and the control information is transmitted from the server computer to the client computer through an information communication network and is information that controls the image forming apparatus.

BRIEF DESCRIPTION OF THE DRAWINGS

Preferred embodiments of the present invention will be described in detail based on the following figures, wherein.

DESCRIPTION OF THE PREFERRED EMBODIMENTS

Figure 1:
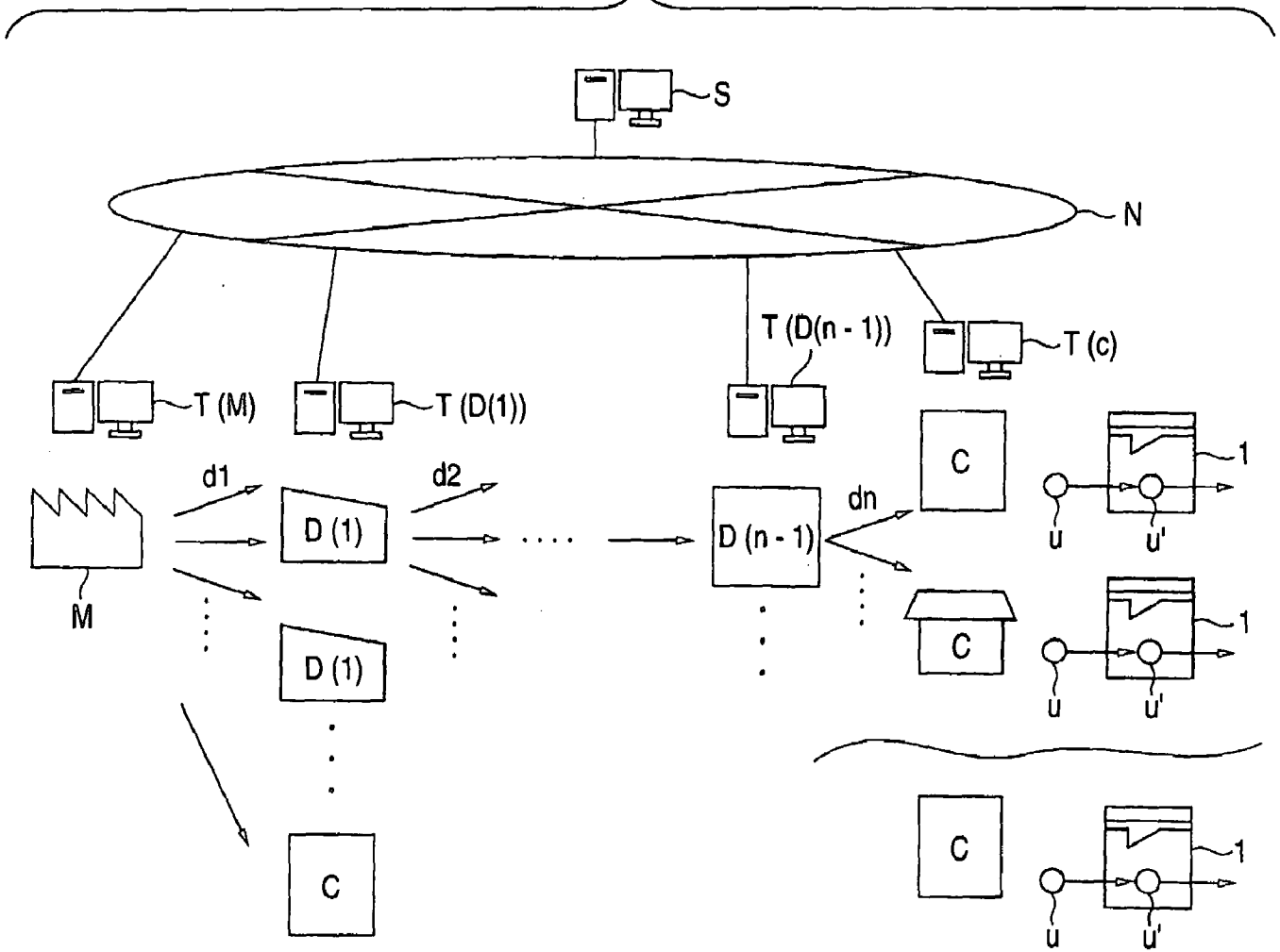
FIG. 1 is a conceptual diagram showing a total distribution system of a detachable unit u according to an embodiment of the invention.

Embodiments of the invention will be described below. FIG. 1 is a conceptual diagram showing a total distribution system of a detachable unit u according to an embodiment of the invention.

The distribution system itself will be described. A detachable unit u (such as a process cartridge and a fixing device unit) is manufactured in a manufactory M, and the detachable unit u is delivered to an end customer C through a distributor D, such as a sales subsidiary (including an affiliate company and an OEM partner). In some cases, the detachable unit u is delivered to an end customer C directly from a manufactory M. The detachable unit u is replaced with a spent detachable unit u' in an image forming apparatus 1 of the end customer C.

There are wide variations in regions, countries and districts of the end customer C. According thereto, there are wide variations in languages, environments (such as temperature and humidity) and paper quality of a recording sheet used by the end customer C. There is also a wide variation in demand standard with respect to an image quality of the end customer C.

A client-server system supporting the distribution system will be described. The client-server system is constituted with a server computer S and plural client computers T, which are connected to the Internet N (information communication network). The client computers may be constituted, for example, with a client computer T(M) at the manufactory of the detachable unit u, a client computer T(D) at the distributor (including a sales subsidiary, an OEM partner and a warehouse), and a client computer T(C) at the end customer. Information communication is made between the server computer S and the client computers T through the Internet N.

Figure 2:
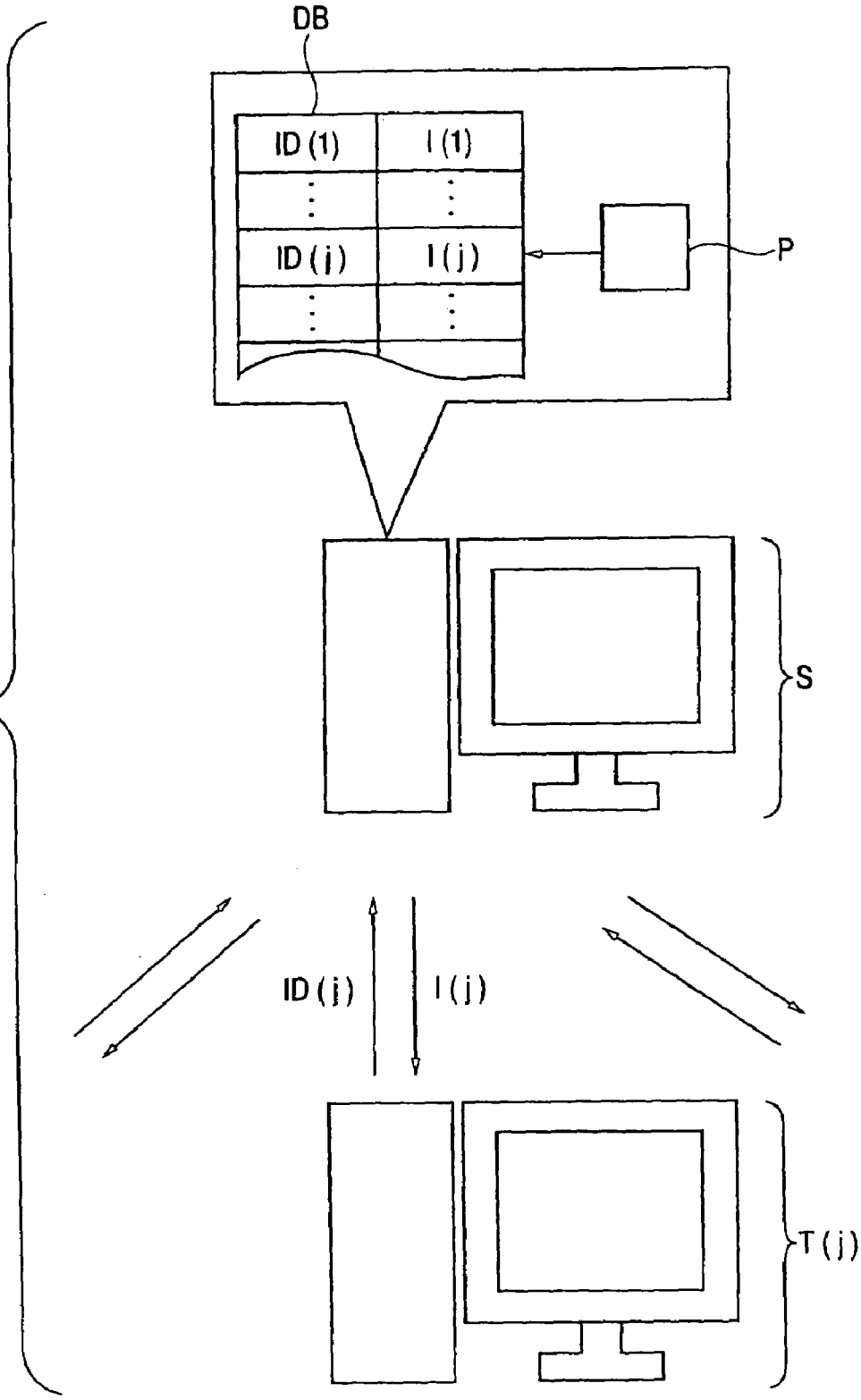
FIG. 2 is a diagram showing information communication between a server computer S and a client computer T(j)

FIG. 2 shows information communication between a server computer S and a client computer T(j). A database DB and a delivery program P are stored in a memory device of the server computer S. The database DB stores sets of identification information ID(1), ID (2) . . . and written information I(1), I(2) . . . for the client computers T(1), T(2) . . . , respectively. In the case where one of the client computers T(j) sends the identification information ID(j) thereof and a request to send to the server computer S, the delivery program P of the server computer searches the database DB based on the identification information ID(j) contained in the request to send and sends the corresponding write information I(j) to the client computer T(j).

Figure 3:
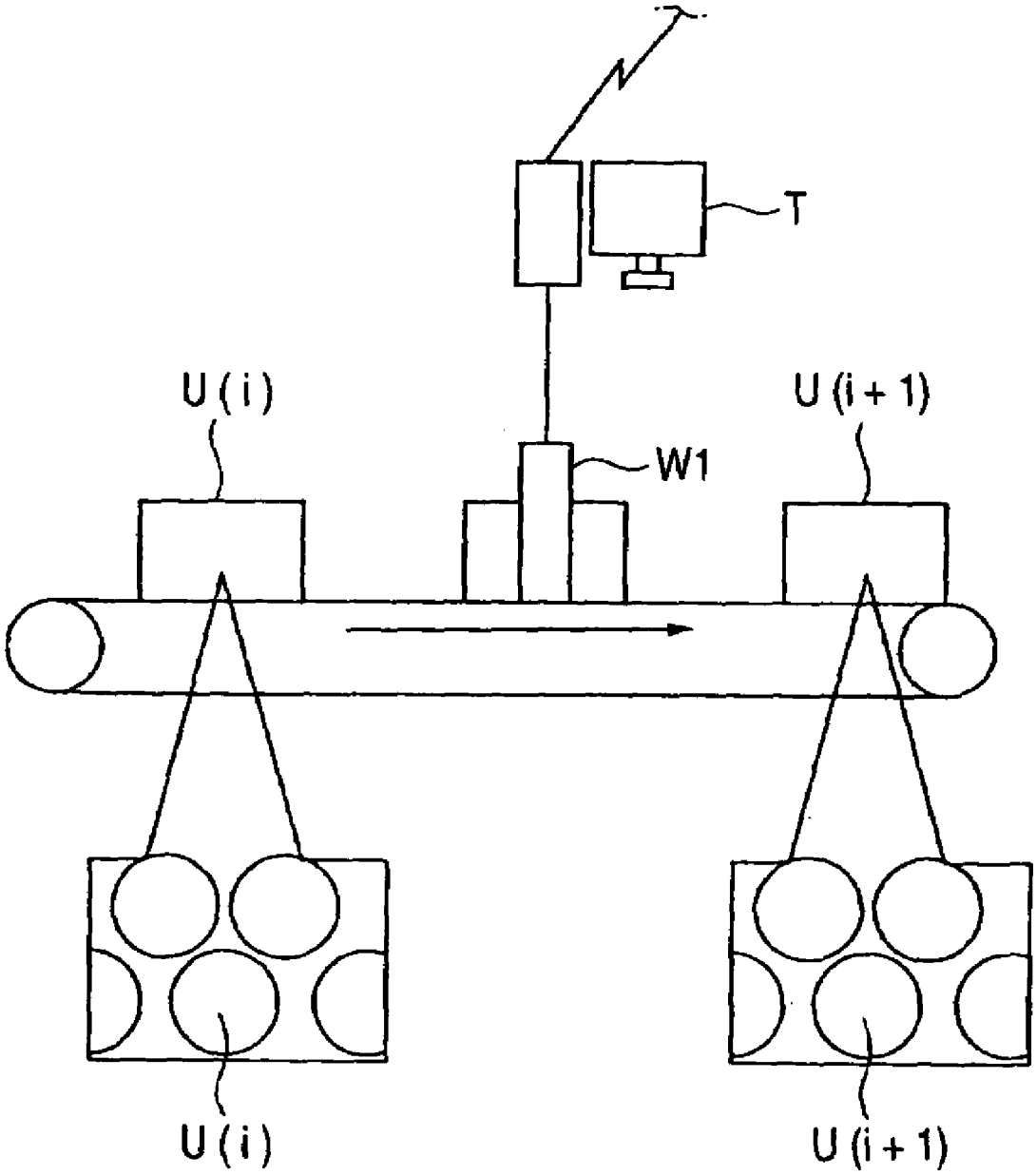
FIG. 3 is a conceptual diagram showing a constitution of a client system according to one embodiment.
Figure 4:
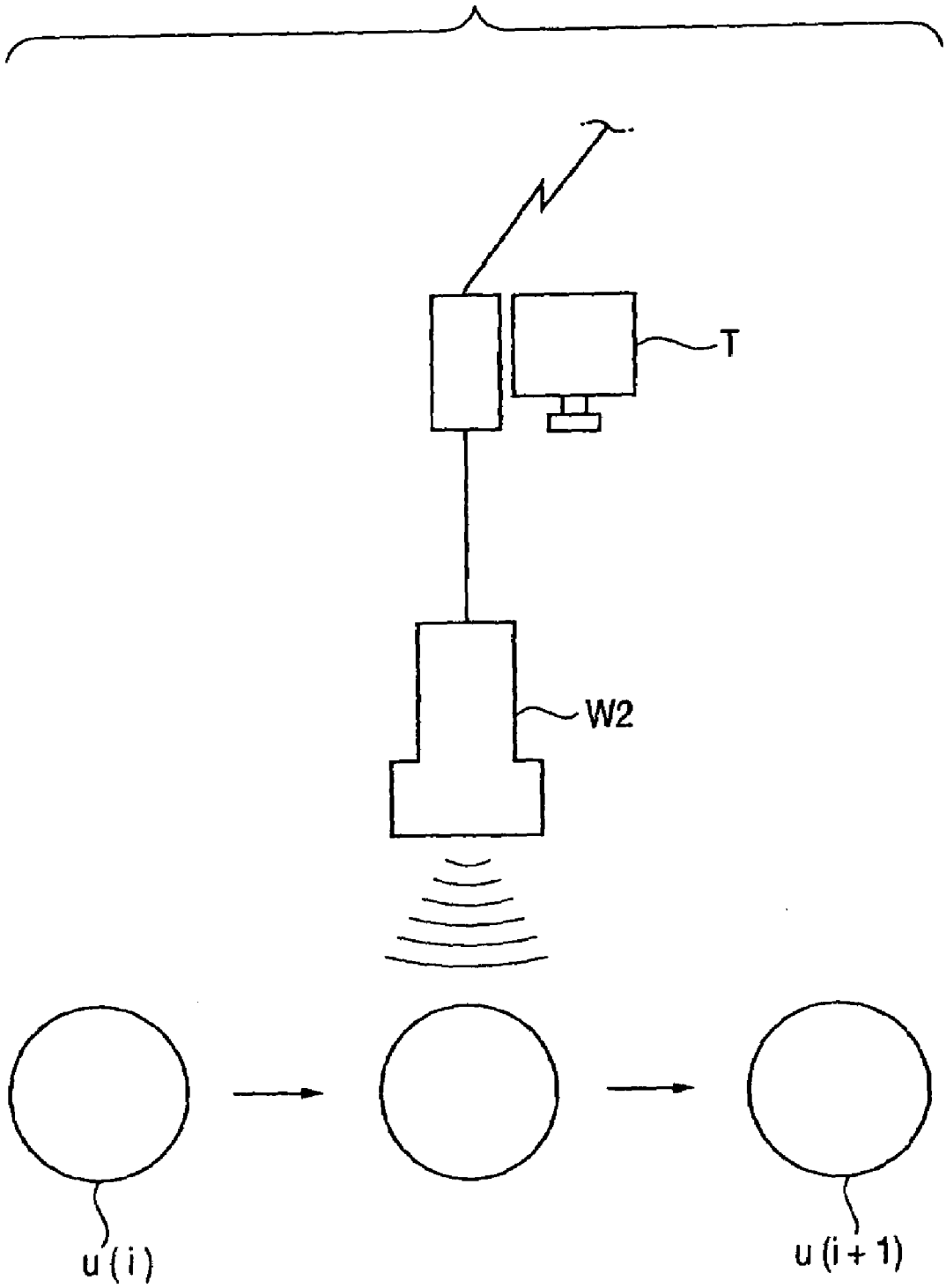
FIG. 4 is a conceptual diagram showing a constitution of a client system according to another embodiment.
Figure 5:
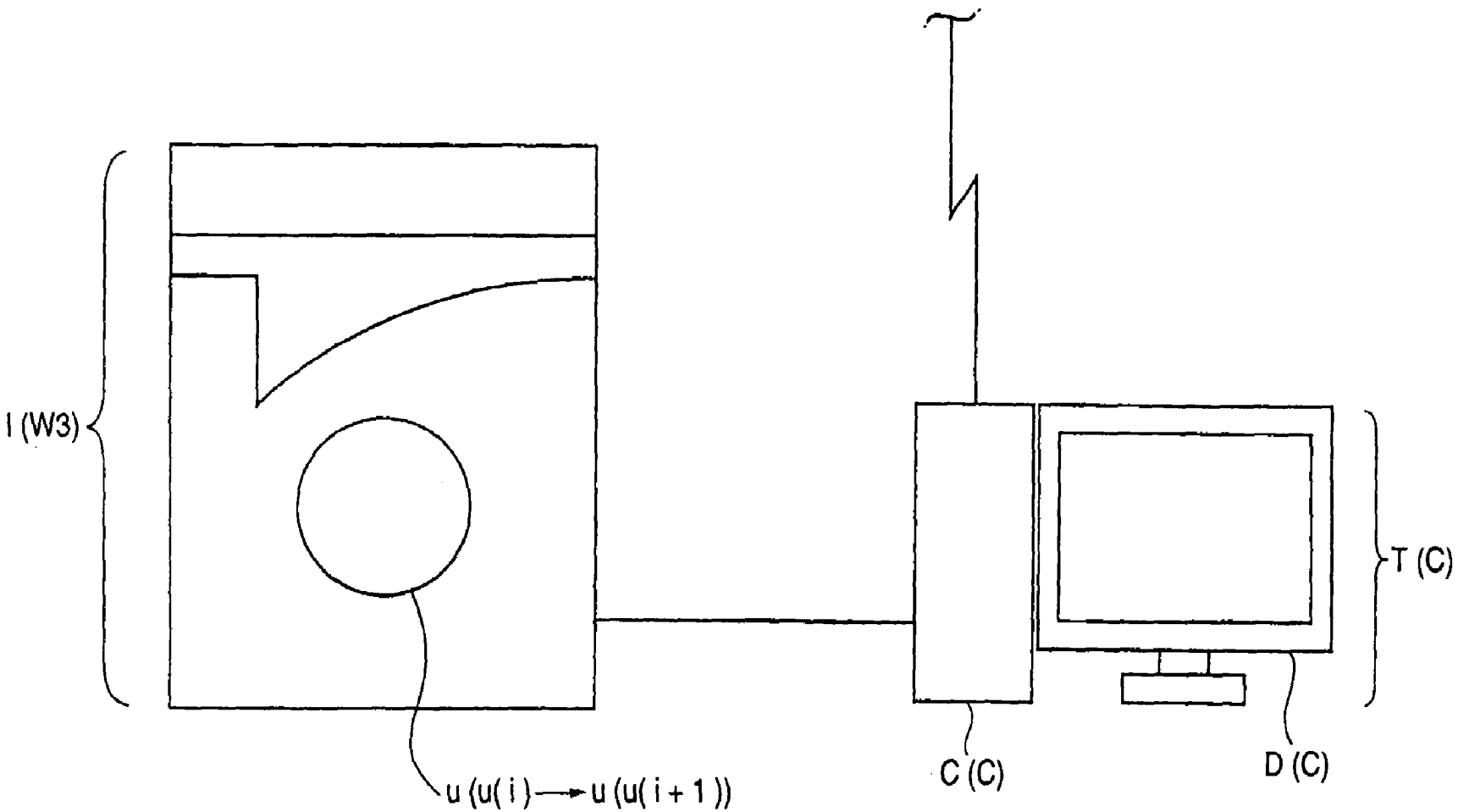
FIG. 5 is a conceptual diagram showing a constitution of a client system according to still another embodiment.
Figure 6:
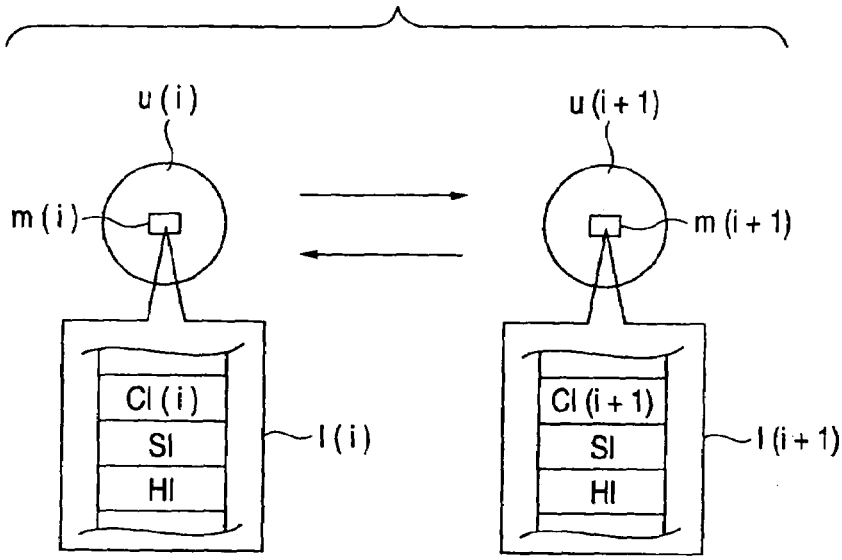
FIG. 6 is a conceptual diagram showing a status where information in a memory part m of a detachable unit u is updated.

FIGS. 3, 4 and 5 are conceptual diagrams showing constitutions of the client system. FIG. 6 is a conceptual diagram showing a status where information in the memory part m of the detachable unit u is updated.

FIG. 3 shows a client system containing a writing device W1 of a relatively large scale and a client computer T. The writing device W1 intends to write on a cardboard box U conveyed on a belt conveyer. Plural detachable units u are packed in the cardboard box U. Upon passing the cardboard box U conveyed on a belt conveyer through the writing device W1, the written information I(i) stored in the memory part m constituted with semiconductor memory chips of the detachable unit u is updated to I(i+1) by wireless. In other words, the memory part m is updated from m(i) to m(i+1), and the detachable unit u is updated from u(i) to u(i+1) (see FIG. 6).

FIG. 4 shows a client system containing a handy type writing device W2 of a relatively small scale and a client computer T. The writing device W2 intends to write on a detachable unit u that has not been mounted on an image forming apparatus main member. The written information I stored in the memory part m of the detachable unit u unpacked from a cardboard box U is updated from I(i) to I(i+1) by wireless (see FIG. 6).

FIG. 5 shows a client system containing a writing device W3 as an image forming apparatus 1 and a client computer T. The writing device W3 (i.e., the image forming apparatus 1) intends to write on a detachable unit u mounted on an image forming apparatus main member. The written information I stored in the memory part m of the detachable unit u mounted on the image forming apparatus main member is updated from I(i) to I(i+1) by wire or wireless (see FIG. 6).

FIG. 6 is a conceptual diagram showing a status where written information I in a memory part m of a detachable unit u is updated. In this embodiment, the written information I stored in the memory part m contains control information CI, specification information SI and history information HI. The image forming apparatus 1 is controlled based on the written information I, details of which will be described later. In some cases (such as a case where the detachable unit u is returned), the written information I may be contrary updated from I(i+1) to I(i).

The control information CI is stored corresponding to destinations (such as a distributor D and an end customer C) of the distribution process. For example, in the case of a detachable unit u for foreign sales, examples of the control information CI thus stored and updated include image formation parameters (such as an electrostatic charge parameter, an exposure parameter, a development parameter, a transfer parameter, a fixation parameter and at least one of display languages) corresponding to paper (recording sheet) that is frequently used in the country in question. Furthermore, examples of the control information CI also include image formation parameters corresponding to an environment specification (such as temperature, humidity and atmospheric pressure) of the destination, image formation parameters corresponding to a demand (with respect, for example, to image quality and productivity) of the end customer C, and image formation parameters corresponding to a power supply voltage of the end customer C.

The specification information SI is stored corresponding to the specification of the detachable unit u. For example, in the case where the detachable unit u is a fixing unit, examples of the specification information SI thus stored include heat roll information (such as heat conduction characteristics and thickness of respective layers), and a pressure roll information (such as a pressing force, hardness, thickness of respective layers, and a service life defined by the specification (standard service life)). In the case where the detachable unit u is a process cartridge, examples of the specification information SI thus stored include a thickness of a photoreceptor and a service life of a photoreceptor defined by the specification. In the case where the detachable unit u is a toner cartridge, examples of the specification information SI thus stored include characteristics of the toner and the amount of the toner (i.e., the service life characteristics).

The history information HI is stored corresponding to the use history of the detachable unit u (during the use thereof upon being mounted on the image forming apparatus 1). For example, in the case where the detachable unit u is a fixing unit, examples of the history information HI thus stored include an accumulated rotation number of a heat roll, a number of lighting of a heater lamp, a duration of lighting, a number of sheets of paper passed and number of sheets of paper by paper sizes. In the case where the detachable unit u is a process cartridge, examples of the history information HI thus stored include a rotation number of a photoreceptor. In the case where the detachable unit u is a toner cartridge, examples thereof include a fed amount of a toner.

Figure 7:
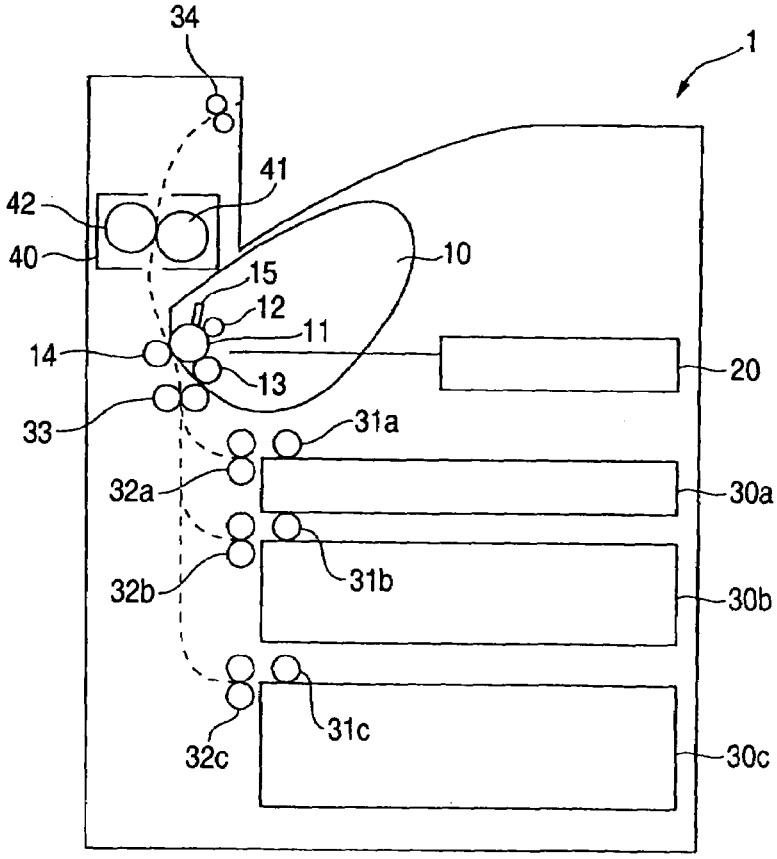
FIG. 7 is a conceptual cross sectional view showing a constitution of an image forming apparatus 1, to which a detachable unit u is detachable.

FIG. 7 is a conceptual cross sectional view showing a constitution of an image forming apparatus 1, to which a detachable unit u is detachable. The basic structure of the image forming apparatus 1 will be described. The image forming apparatus 1 is constituted with an image forming part, a paper conveying part and a fixing unit 40.

The image forming part is constituted with a process cartridge 10, an exposing device 20 and a transfer roll 14. The process cartridge 10 integrally contains a photoreceptor drum 11 as an image carrying member, a charging roll 12 as a charging unit for uniformly charging the surface of the photoreceptor drum 11, a developing device 13 as a developing unit for developing with a toner an electrostatic latent image thus electrostatically written by the exposing device 20, and a cleaning blade 15 as a cleaning unit for removing the toner remaining on the surface of the photoreceptor drum 11 after transferring. The paper conveying part contains sheet trays 30*a* to 30*c*, in which recording sheets of different kinds are housed, respectively, pickup rolls 31*a* to 31*c*, retarding rolls 32*a* to 32*c*, a pair of resist rolls 33, and a pair of delivery rolls 34. The fixing unit 40 contains a heating roll 41 and a pressure roll 42, which have heaters inside, respectively.

The basic operation of the image forming apparatus 1 will be described. The exposing device 20 writes an electrostatic latent image on the surface of the photoreceptor drum 11 based on an image formation instruction input from an image reading device (such as a scanner) or a computer, which is not shown in the figure. The electrostatic latent image is developed by the developing device 13 to form a toner image on the surface of the photoreceptor drum 11. The toner image is electrostatically transferred with the transfer roll 14 onto paper conveyed from the sheet tray 30 in timely moment. The paper is held and conveyed to a nip portion of the heating roll 41 and the pressure roll 42 in the fixing unit 40, and the toner image is fixed through action of heat and pressure thereon. The fixed paper is delivered to the outside of the image forming apparatus 1 with the pair of delivery rolls 34. The toner remaining on the photoreceptor drum 11 upon transfer is removed from the surface of the photoreceptor drum 11 with the cleaning blade 15.

The aforementioned image forming operation is carried out under various kinds of control based on the image formation parameters.

Figure 8:
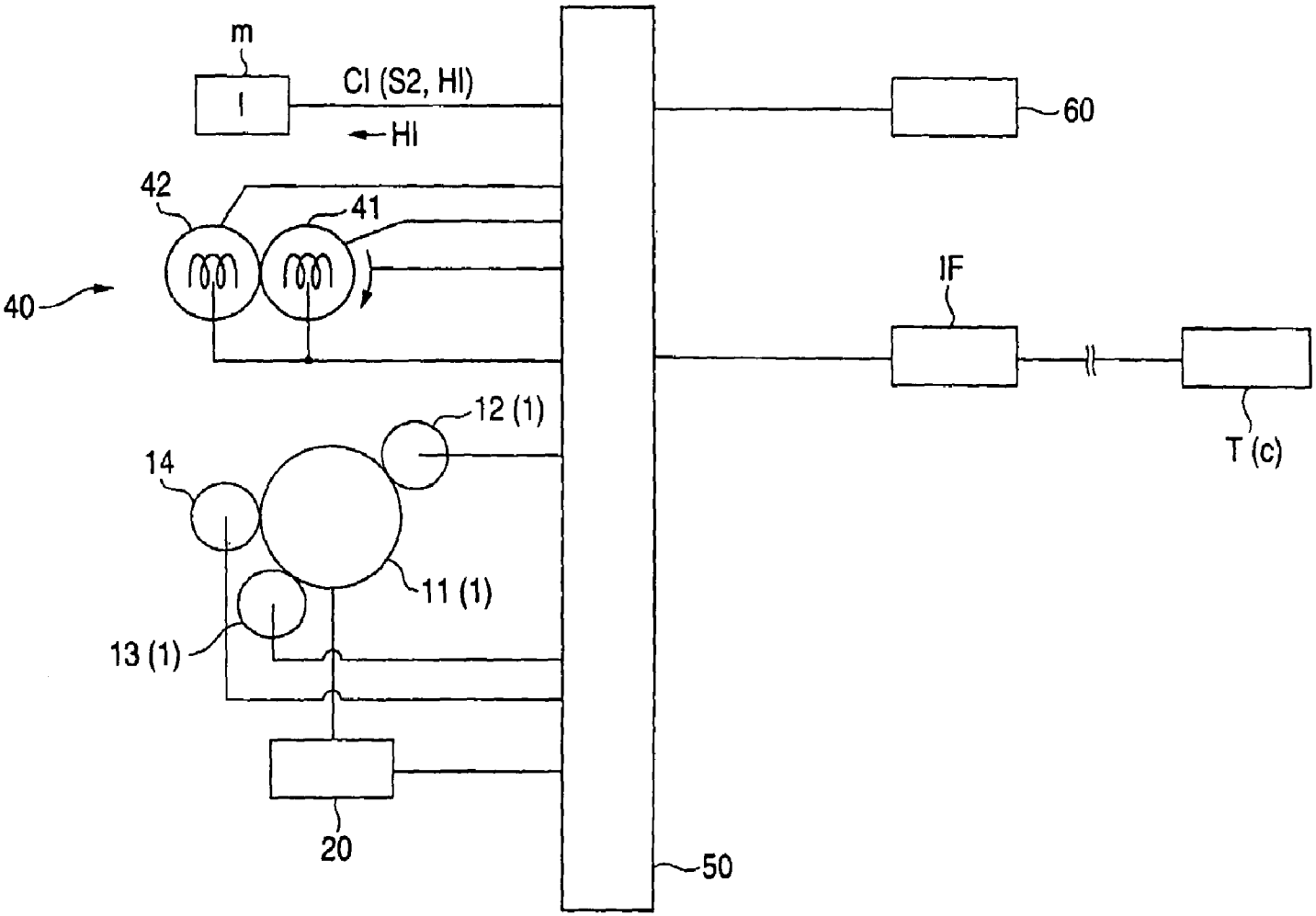
FIG. 8 is a control block diagram showing a control system of the image forming apparatus 1 shown in FIG. 7.

FIG. 8 is a control block diagram showing a control system of the image forming apparatus 1. The control system is constituted mainly with a control part 50, and an input part of the control part 50 includes a memory part m (of the detachable unit u), a user interface 60, and an external input and output interface IF. An output part of the control part 50 includes the heating roll 41, the pressure roll 42, the charging roll 12, the exposing device 20, the developing device 13 and the transfer roll 14, in addition to the memory part m, the user interface 60 and the external input and output interface IF. The input and output may also be attained to a client computer T(C) of the end customer C through the external input and output interface IF.

EXAMPLE

The control of the image forming apparatus 1 will be described in detail with reference to the following examples.

Example 1

Figure 9:
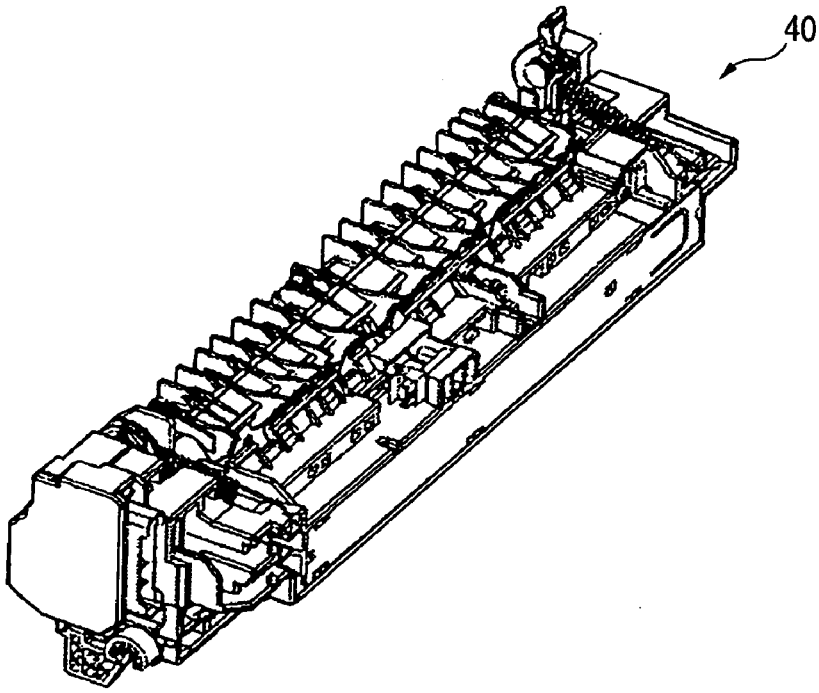
FIG. 9 is a perspective view showing a fixing unit.

A case where the detachable unit u is a fixing unit 40 will be described. FIG. 9 is a perspective view showing a fixing unit 40. A control part 50 controls the image forming operation based on written information I stored in a memory part m of the fixing unit 40. For example, the service life of the fixing unit 40 is evaluated based on specification information SI and history information HI contained in the written information I, and in the case where the remaining service life approaches the end (i.e., the fatigue of the fixing unit 40 is increased), the bias voltage applied to the heating roll 41 and the pressure roll 42 may be controlled to be increased. According to the operation, the charging amount of the heating roll 41 and the pressure roll 42 can be maintained, whereby the unfixed toner can be continuously prevented from being attached. The control part 50 updates the history information HI in the memory part m every image formation.

Example 2

Figure 10:
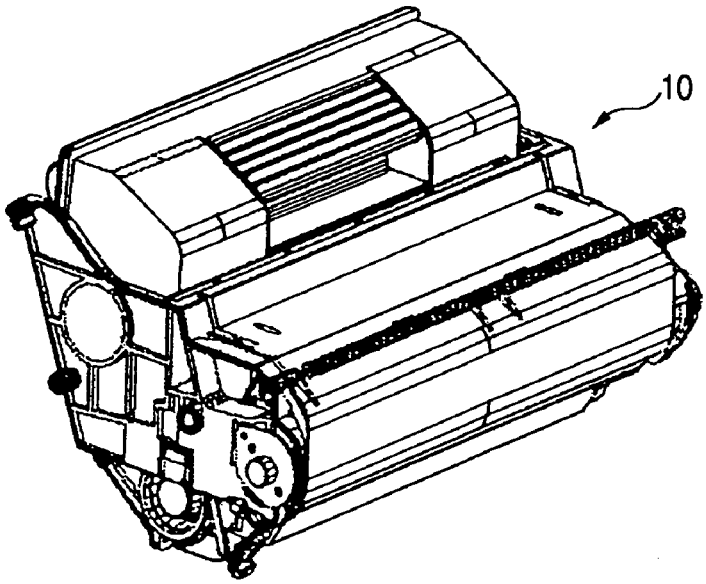
FIG. 10 is a perspective view showing a process cartridge.

A case where the detachable unit u is a process cartridge 10 will be described. FIG. 10 is a perspective view showing a process cartridge 10. A control part 50 controls the image forming operation based on written information I stored in a memory part m of the process cartridge 10.

For example, the service life of the process cartridge 10 is evaluated based on specification information SI and history information HI contained in the written information I, and in the case where the remaining service life approaches the end (i.e., the fatigue of the process cartridge 10 is increased), the bias voltage applied to the transfer roll 14 may be controlled to be increased. According to the operation, the decrease in the charging amount of the toner is compensated to maintain good transfer property. In the case where the remaining service life approaches the end, information of a distributor (such as, the name, phone number, facsimile number and address of the distributor) contained in the control information CI may be displayed on a user interface device 60.

Furthermore, in the case where the destination is a cold district or the case where paper with poor fixing property is used, it is possible that based on the control information CI stored corresponding to the destination, the surface temperature of the heating roll 41 and the pressure roll 42 is controlled to a higher value than that for the ordinary district, the pre-heating time of the heating roll 41 and the pressure roll 42 is controlled to be increased, and a user selects an appropriate fixing temperature. In the case where the atmospheric pressure of the destination is low (for example, in a district of high altitude), the bias voltage applied to the transfer roll 14 may be controlled to a lower value than that for the ordinary district, whereby leakage that is liable to occur in a district of a low atmospheric pressure (i.e., the so-called high-altitude leakage) can be prevented. Similarly, the image formation operation can be controlled based on the control information based on the power supply voltage of the destination and the demands of the end customer C.

Example 3

Figure 11:
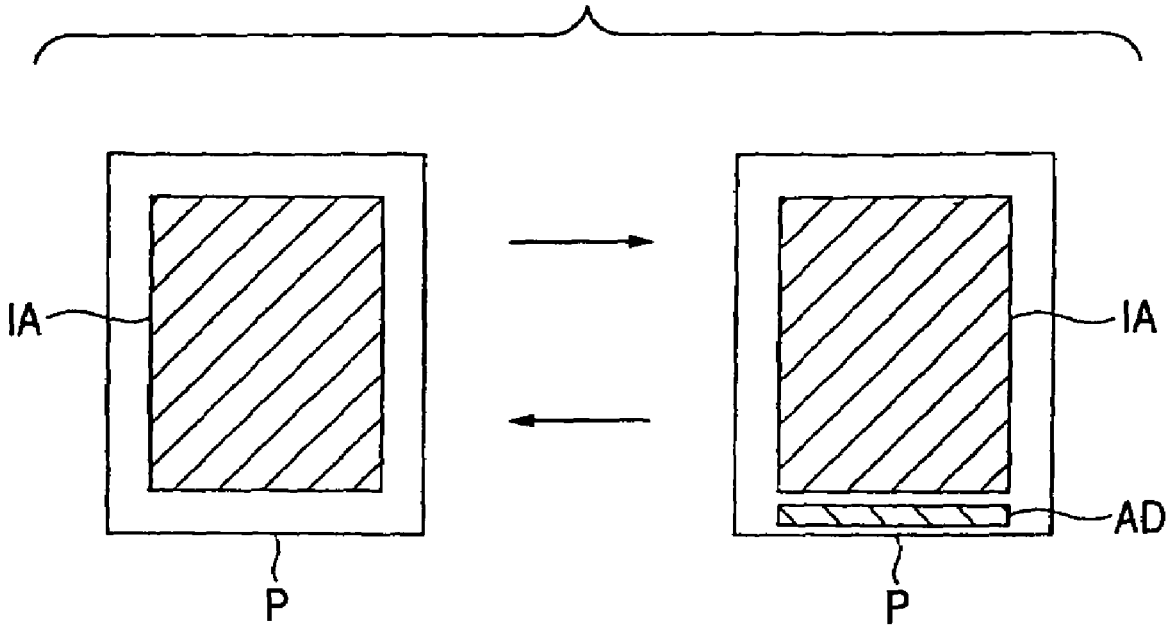
FIG. 11 is a diagram showing presence and absence of advertisement on paper p.

Another case where the detachable unit u is a process cartridge 10 will be described. A control part 50 controls presence or absence of image formation based on the written information I stored in a memory part m of the process cartridge 10. FIG. 11 shows presence and absence of advertisement on paper p. Under normal conditions, a toner image is formed on an image forming area IA at the center of the paper p. In other words, there is a non-image forming area having no toner image formed, on the periphery of the paper p. In the case where the control information CI contains an "advertisement displaying instruction", the control part 50 displays an advertisement AD, for example, on the non-image forming area. In this case, the account may be controlled to be reduced. It is also possible that a user selects through the user interface device 60 or the client computer T(C) as to whether or not the advertisement is output.

As described in detail in the foregoing, the invention can provide a technical solution for easily carrying out detailed image formation control corresponding to respective customers, i.e., a detachable unit, an image forming apparatus, a server computer, a computer program and client system for easily carrying out detailed image formation control corresponding to respective customers.

The entire disclosure of Japanese Patent Application No. 2003-151254 filed on May 28, 2003 including specification, claims, drawings and abstract is incorporated herein by reference in its entirety.

What is claimed is:

1. An image forming apparatus comprising an image forming apparatus main member, a detachable unit detachable to the image forming apparatus main member, and a control means for controlling operation of the image forming apparatus, the detachable unit comprising a memory part storing information containing control information, and the control means controlling operation of the image forming apparatus based on the information stored in the memory part, wherein the control information stored in the memory part is capable of being updated by wireless while the detachable unit is detached from the image forming apparatus main member, wherein the memory part stores advertisement information showing advertisement as the control information, and the control means prints the advertisement information on a recording sheet upon forming an image, wherein the control means displays the advertisement information on a non-image area of the recording sheet upon forming the image.

2. The image forming apparatus as claimed in claim 1, wherein the image forming apparatus has an input means for inputting information from a user, and the control means prints the advertisement information on a recording sheet based on a preference of the user input from the input means.

3. The image forming apparatus as claimed in claim 1, wherein the image forming apparatus has an accounting means for accounting corresponding to a number of times of image formation, and the control means reduces the account in the case where the advertisement information is printed upon forming an image.

* * * * *